US005131129A

United States Patent [19]

Garman

[11] Patent Number: 5,131,129

[45] Date of Patent: Jul. 21, 1992

[54] TOOL ASSEMBLY

[75] Inventor: James A. Garman, Eureka, Ill.

[73] Assignee: Caterpillar Inc., Peoria, Ill.

[21] Appl. No.: 750,341

[22] Filed: Aug. 27, 1991

[51] Int. Cl.[5] ..... E21B 19/00

[52] U.S. Cl. ..... 29/252

[58] Field of Search ..... 29/252, 237, 238, 243.5, 29/452, 520, 391.4, 453.15, 453.16; 72/453.15, 453.16

[56] References Cited

U.S. PATENT DOCUMENTS

| | | | |
|---|---|---|---|
| 1,422,390 | 7/1922 | Timm | 29/263 |
| 1,465,124 | 8/1923 | Gardner | 29/263 |
| 3,139,787 | 7/1964 | Bochman | 29/252 |
| 3,662,451 | 5/1972 | Wagner | 29/263 |
| 3,937,123 | 2/1976 | Matuschek et al. | |
| 3,970,336 | 7/1976 | O'Sickey et al. | 29/237 |
| 4,345,361 | 8/1982 | Baumann | 29/252 |
| 4,610,066 | 9/1986 | Cline | |
| 4,646,411 | 3/1987 | Hankins | |
| 4,682,395 | 7/1987 | Klann | |
| 4,724,608 | 2/1988 | Parrott | |

*Primary Examiner*—Robert C. Watson

*Attorney, Agent, or Firm*—Claude F. White

[57] ABSTRACT

A tool assembly for installing and removing a fastening apparatus in a mechanical joint between two or more elements includes a rod which is axially movable, a plurality of tools positionable on the movable rod, and a power source for moving the rod member between first and second positions. The fastening apparatus includes a reusable fastening member and a disposable and deformable ring adapted to be deformed into the joint by said tool assembly. The tools can be manipulated into various positions on the movable rod for installing and removing the fastening apparatus. Securing together large size elements, such as cutting edges and tooth adapters on earthmoving buckets and blades, using conventional nut and bolt threaded fasteners, requires extremely large service tools and considerable time and effort by several service personnel. The threaded fasteners are generally not reusable due to corrosion abrasive wear. The subject tool assembly quickly and easily installs, or removes, a reusable mechanical fastening apparatus in a joint between a plurality of large work elements.

15 Claims, 6 Drawing Sheets

Fig. 12.
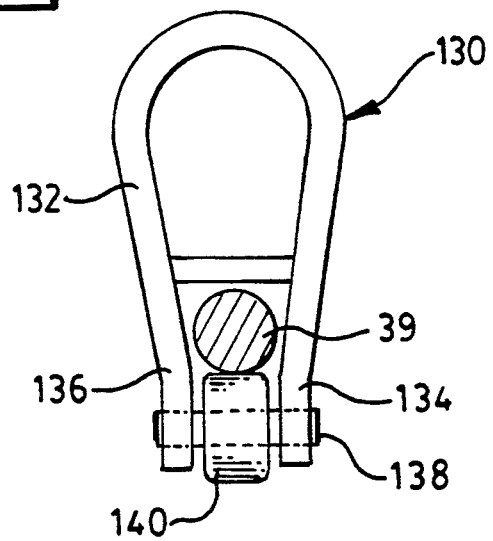
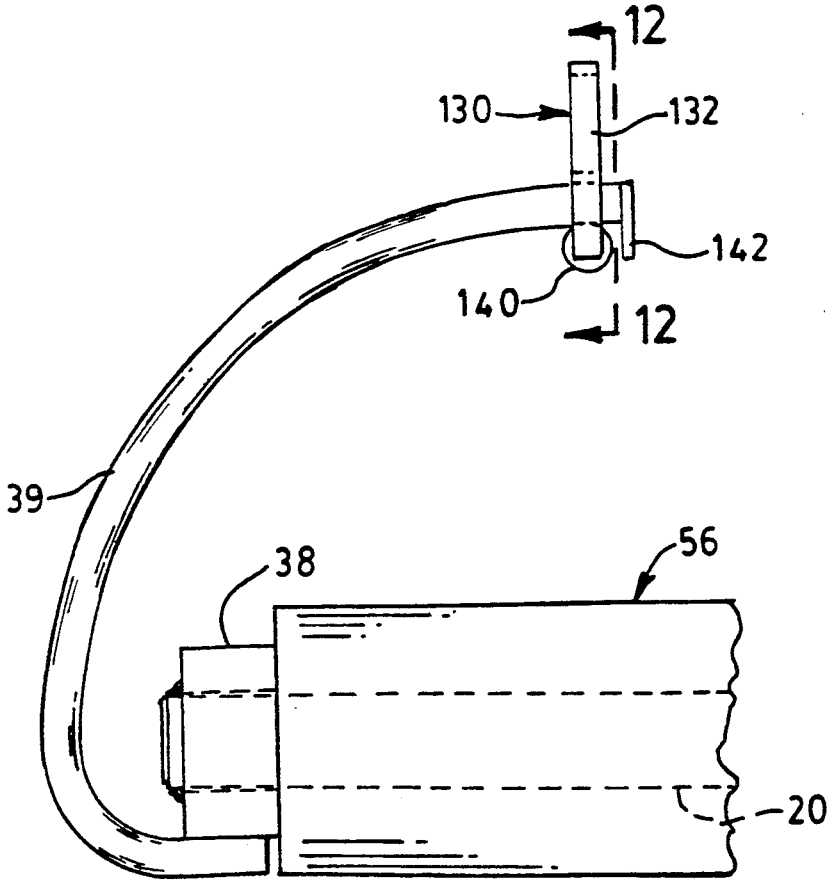
Fig. 11.

TOOL ASSEMBLY

TECHNICAL FIELD

This invention relates generally to a tool assembly and more particularly to a tool assembly which is useful in installing and removing a fastening apparatus in a mechanical joint between a plurality of elements.

BACKGROUND ART

As the size of earthmoving and construction vehicles increases to gargantuan proportions, fastening together various components of such vehicles becomes more difficult. Such components as replaceable wear plates and tooth adapters for loader buckets are normally releasably secured to the loader bucket by conventional threaded fasteners, such as mating bolts and nuts. However, the increased size of the vehicle and components makes use of such extremely large conventional threaded fasteners time consuming and inefficient. Large and expensive service tools and wrenches are required to install and remove the threaded fasteners. When the wear plates and adapters are replaced or serviced, the threaded fasteners are often difficult to remove due to corrosion and abusive wear, such wear also precluding reuse of the fasteners.

The present invention is directed to overcoming one or more of the problems as set forth above.

DISCLOSURE OF THE INVENTION

In one aspect of the present invention, a tool assembly for installing a fastening apparatus in a joint between a plurality of elements includes a movable rod, a plurality of tools positionable on the rod, and a first means for moving the rod between first and second positions. The fastening apparatus includes a fastening member having a grooved surface and a deformable ring. At the first position of the rod, the fastening member is spaced from the joint and at the second position of the rod, the fastening member is positioned within the joint. The tool assembly further includes a second means for deforming the ring into the groove of the fastening member.

In another aspect of the present invention, a tool assembly for removing a fastening apparatus from fastening engagement with a plurality of elements includes a movable rod, a cup-shaped tool positionable on the rod, an elongated tool, a securing member engageable with the rod, and means for moving the rod between first and second positions. The fastening apparatus includes a fastening member and a deformed ring. At the first position of the rod, the fastening member is positioned within the joint and at the second position of the rod, the fastening member is spaced from the joint.

As manufacturers continue to increase the size of earthmoving machines and their associated working tools, conventional threaded fasteners for joining replaceable elements on the working tools become expensive and difficult to manipulate. Conventional threaded fasteners are also difficult to remove, due to wear and corrosion, and are in most cases not reusable.

The subject tool assembly quickly and efficiently installs a fastening apparatus in a mechanical joint between a plurality of work elements. The subject tool assembly also easily removes the fastening apparatus from the joint. The fastening member of the fastening apparatus is generally reusable.

BRIEF DESCRIPTION OF THE DRAWINGS

FIG. 11 is a diagrammatic side elevational view of a portion of the tool assembly showing a supporting bail and movable hook assembly; and FIG. 12 is a diagrammatic front elevational view taken generally along the lines 12—12 of FIG. 11.

BEST MODE FOR CARRYING OUT THE INVENTION

Figure 1:
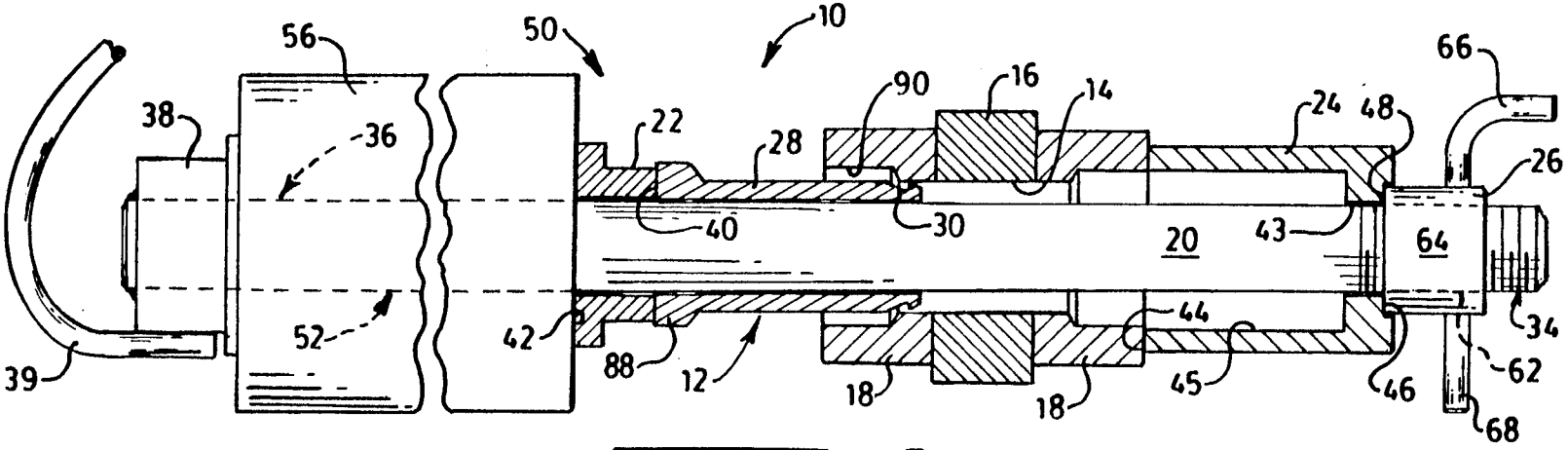
FIG. 1 is a diagrammatic sectional view of the tool assembly of the present invention, the rod of the tool assembly being in a first position.

Referring to the drawings, a tool assembly 10 for installing a removable fastening or connecting apparatus 12 in a juncture bore or joint 14 between a plurality elements 16 and 18 includes an elongated movable rod or shaft 20, first and second tools 22, 24, and a securing member 26. The fastening apparatus 12 includes a fastening member 28 having a grooved surface 30, and a deformable ring 32. The movable rod 20 has a first threaded end portion 34 and a second end portion 36 having an enlarged head 38. The rod 20 is adapted to penetrate the joint 14, including the elements 16 and 18, and the fastening apparatus 12.

The first tool 22 is positionable on the rod 20 and has first and second surfaces 40, 42, with the first surface 40 being adapted to contact the fastening member 28. The second tool 24 is cup-shaped and is also positionable on the rod 20. The second tool 24 has a bore 43 and a counterbore 45 and first and second surfaces 44, 46, with the first surface 44 being adapted to contact the element 18. The bore 43 is of a size sufficient to accommodate a portion of the rod 20. The securing member 26 is positionable on the first end portion 34 of the rod 20, and has a first surface 48 which is adapted to be in contact with the second surface 46 of the second tool 24.

Figure 2:
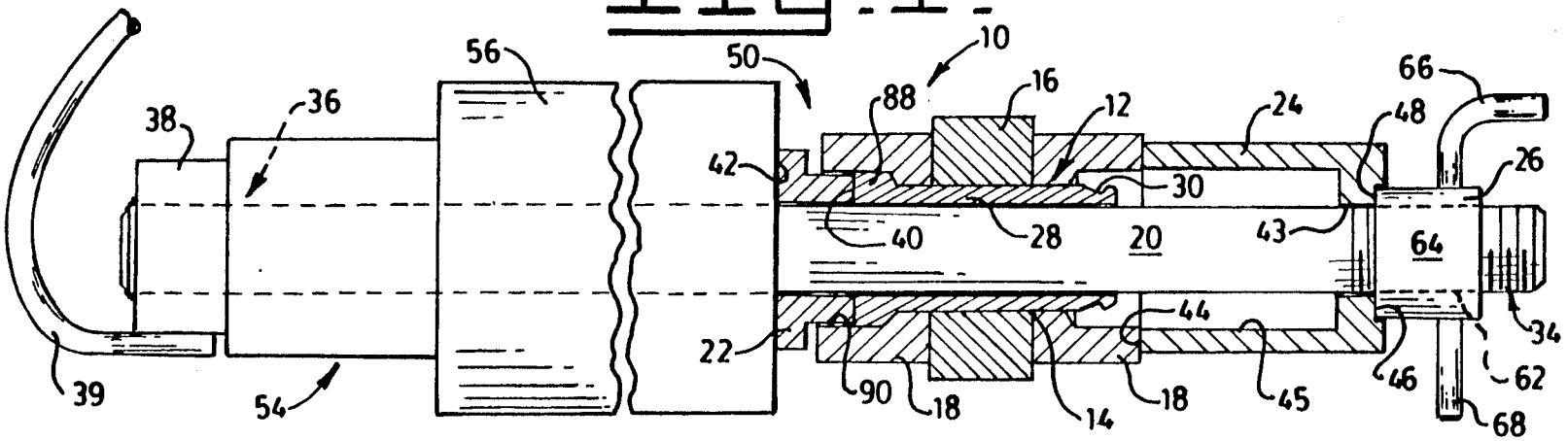
FIG. 2 is a diagrammatic sectional view of the tool assembly, similar to FIG. 1, with the rod being in a second position.

The tool assembly 10 further includes a first means 50 for moving the rod 20 between a first position 52, at which the fastening member 28 is spaced from the joint 14, and a second position 54, at which the fastening member 28 is positioned within the joint 14 and is in contact with the elements 16 and 18. The first and second positions 52, 54 of the rod 20 are shown in FIGS. 1 and 2, respectively. The first means 50 includes a fluid power source 56, including a fluid operated cylinder 58 and piston 60. The enlarged head 38 of the rod 20 is connected to the piston 60 of the fluid power source 56 and the first threaded end portion 34 is connected to the securing member 26. The rod 20 is positioned therefore between the fluid power source 56 and the securing member 26. The securing member 26 is preferably in the form of a nut 26 having an internal threaded portion 62 and an external surface 64. First and second manipulating handles 66, 68 are secured to the surface 64 and extend outwardly thereof. The internal threaded portion 62 is threadably engageable with the threaded end portion 34 of the rod 20.

The tool assembly 10 further includes a second means 70 for deforming the ring 32 into the grooved surface 30 of the fastening member 28. The second means 70 includes an elongated third tool 72 having first and second end portions 74, 76 with the first end portion 74 having an enlarged base and a counterbore 80. The third tool 72 is adapted to replace the second tool 24 on the rod 20, with the first end portion 74 being adapted to contact the deformable ring 32 and the second end portion 76 being adapted to contact the first surface 48 of the securing member. In order to replace the second tool 24 with the third tool 72, the securing member 26 is removed from the threaded end portion 34, the second tool 24 is removed and the third tool 72 is positioned on the rod 20. The securing member 26 is then re-attached to the threaded end portion 34. The second means 70 further includes moving the rod 20 between the first position 52 at which the deformable ring 32 is spaced from and adjacent the grooved surface 30 of the fastening member 28, and the second position 54 at which the deformable ring 32 is deformed and mechanically engaged with the grooved surface 30. Preferably, a hardened bushing 33 is positioned between the deformable ring 32 and the element 18. Advantageously, the tool assembly also includes a curved bail 39 which is attached to the enlarged head 38. The entire tool assembly 10 can be manipulated by the bail 39, using any type or conventional lifting device.

Figure 4:
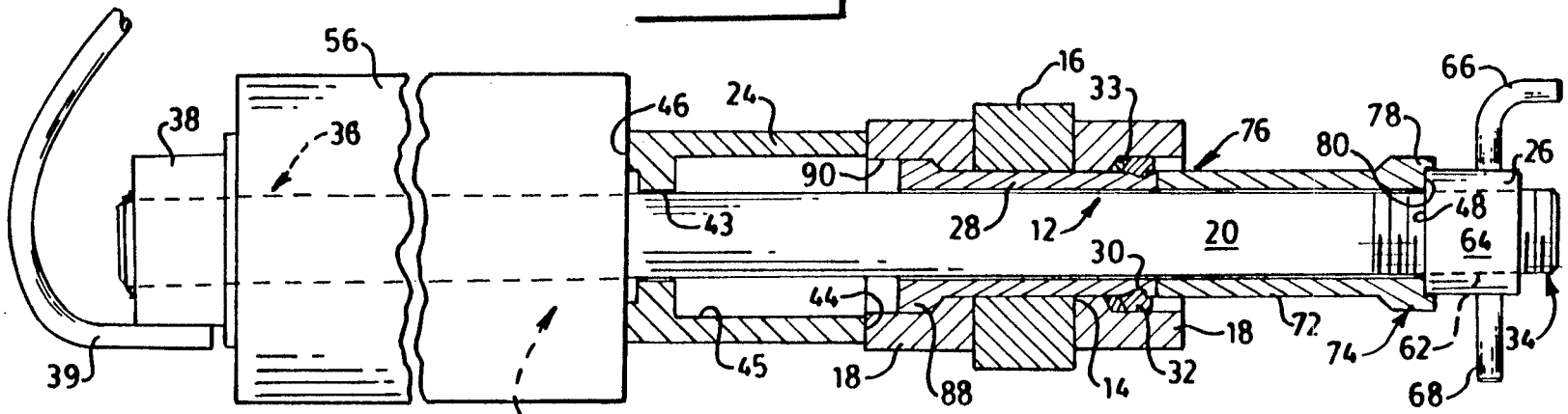
FIG. 4 is a diagrammatic sectional view of the tool assembly of the present invention with the rod being in a first position and just prior to removal of the fastening apparatus from a joint between a plurality of elements.
Figure 5:
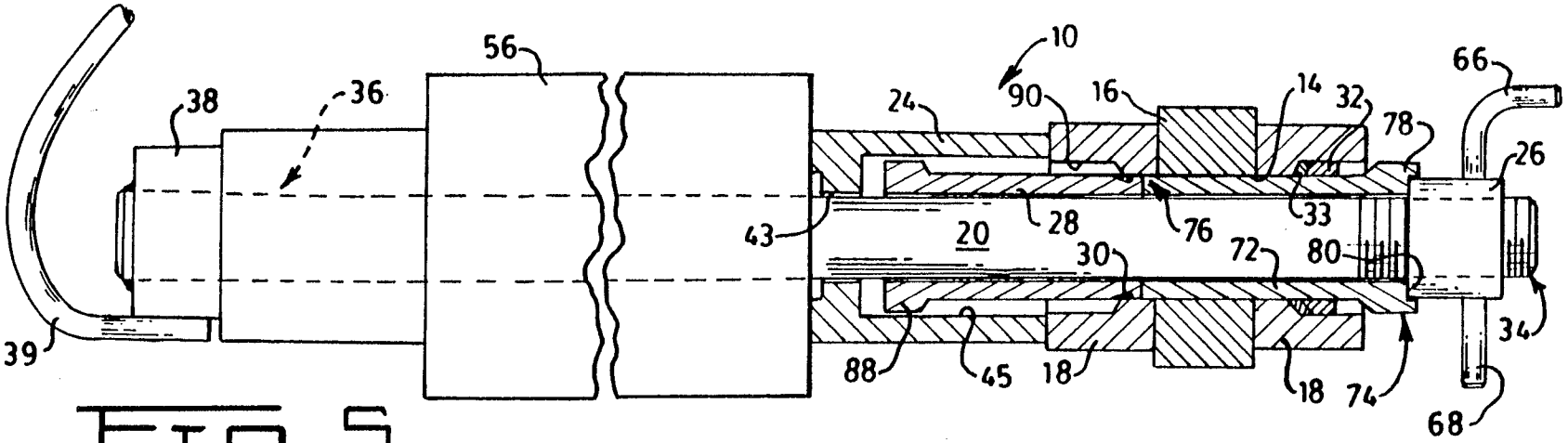
FIG. 5 is a diagrammatic sectional view of the tool assembly, similar to FIG. 4, with the rod being in a second position and the fastening apparatus having been removed from a joint.
Figure 6:
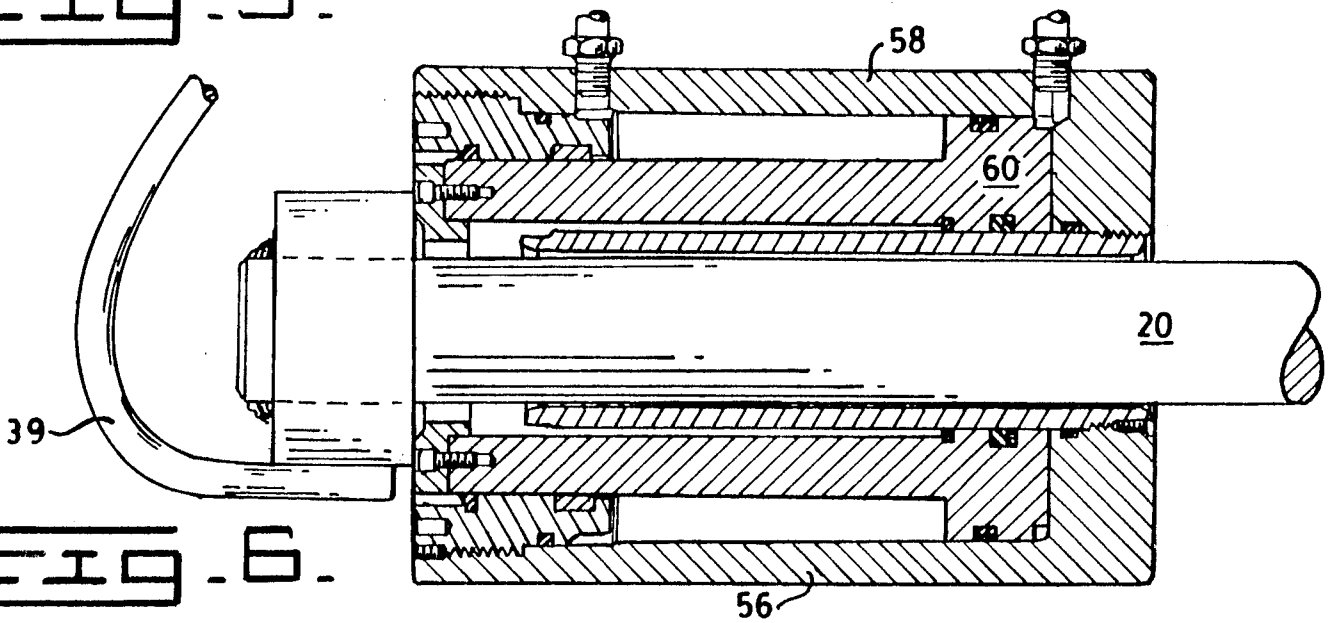
FIG. 6 is a diagrammatic sectional view of a fluid powered apparatus of the present invention.

With particular reference to FIGS. 4 and 5, the tool assembly 10 is also adapted for removing the fastening apparatus 12 from fastening engagement with the elements 16 and 18. For the removal operation, the tool assembly 10 includes the rod 20, the second tool 24, the third tool 72, the securing member 26, and the fluid power source 56. The second tool 24 is positioned on the rod 20 between the power source 56 and the element 18, with the first surface 44 being in contact with the element 18 and the second surface 46 being in contact with the power source 56. The elongated third tool 72 is positioned on the rod 20 with the second end portion 76 being adapted to contact the fastening member 28, and the first end portion 74 being adapted to contact the first surface 48 of the securing member 26. With the tool assembly 10 so configured and positioned, the fluid power source 56 is capable of moving the rod 20 between the first position 52 at which the fastening member 28 is positioned within the joint 14 and the second position 54 at which the fastening member 28 is removed and spaced from the joint 14. As the fastening member 28 is removed from the joint 14, the deformed ring 32 is removed from engagement with the grooved surface 30 and is sheared into several small pieces.

Figure 7:
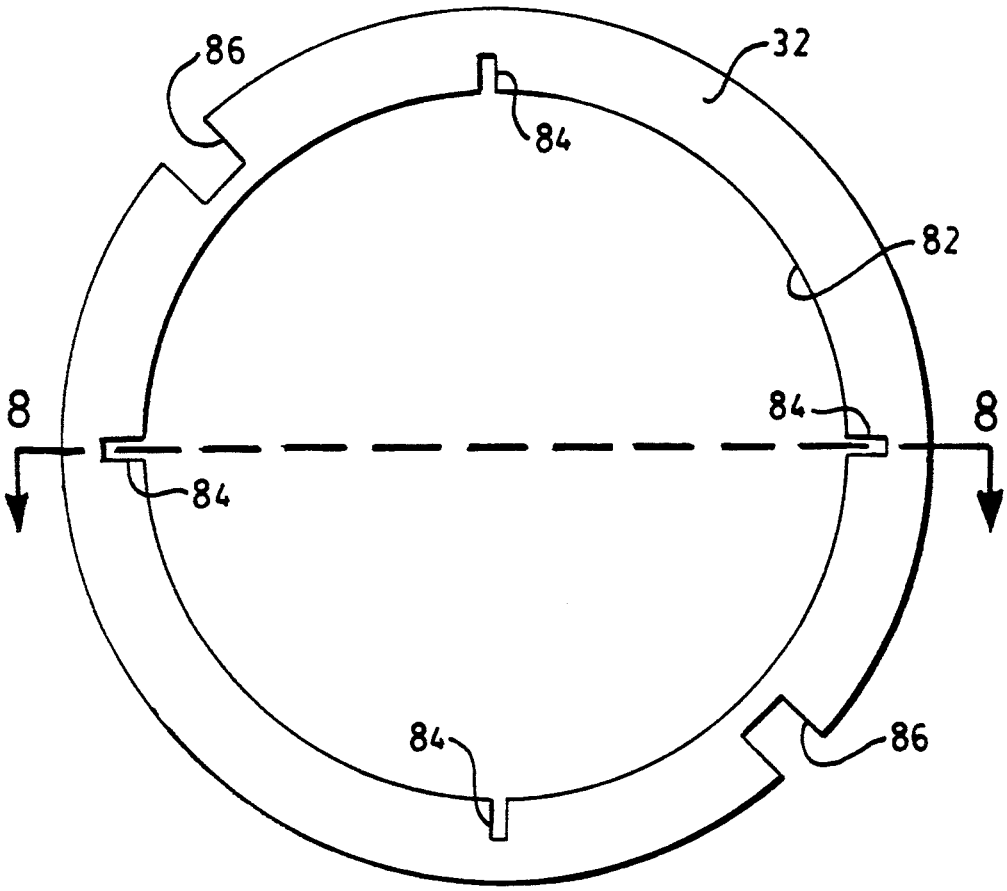
FIG. 7 is a diagrammatic plan view of a deformable ring which the tool assembly of the present invention secures within a joint between elements.
Figure 8:
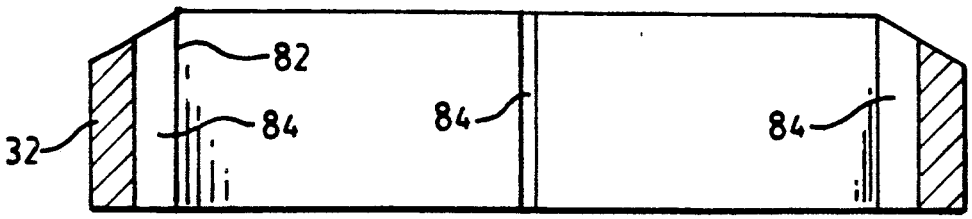
FIG. 8 is a diagrammatic sectional view taken generally along lines 8—8 of FIG. 7.

With particular reference to FIGS. 7 and 8, the deformable ring 32 defines an internal bore 82 which is of a size sufficient to slip over the external peripheral surface of the fastening member 28. The ring 32 also contains a plurality of first slots 84 which open to the internal bore 82, and a plurality of second slots 86 which open to the external peripheral surface thereof. The first and second slots 84, 86 cause the sheared portion of the deformed ring 32 to shear into several small pieces. These small pieces of the sheared ring 32 can easily be removed from the groove surface 30 after the fastening member 28 has been forced from the joint 14. It would also be acceptable to make the ring 32 in two separate semi-circular pieces. This would eliminate the need for the first and second slots 84 and 86 and still permit removal of the sheared ring 32 after the fastening member 28 has been forced from the joint 14.

Figure 3:
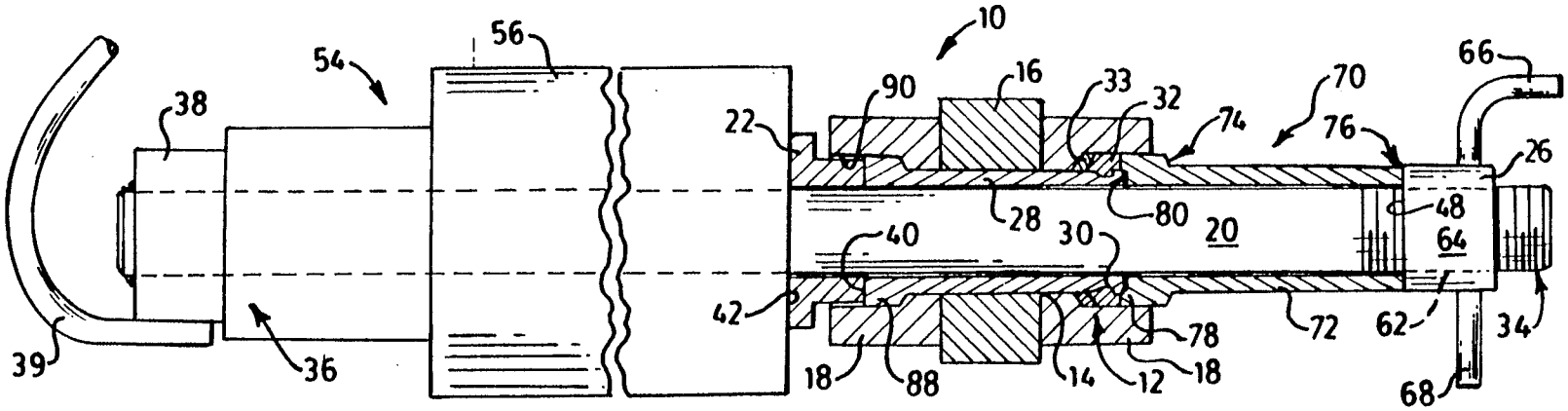
FIG. 3 is a diagrammatic sectional view of the tool assembly of the present invention with the fastening apparatus in place within a joint.

With further reference to FIGS. 3, 4, and 5, the fastening member 28 has an enlarged diameter head portion 88 and the element 18 defines a counterbore 90 which is of a size sufficient to accommodate the head portion 88. When the fastening member 28 is fully installed into the joint 14, the head portion 88 bottoms on the base of the counterbore 90. During disassembly and removal of the fastening member 28 from the joint 14, the head portion 88 moves into the counterbore 45, which is of a size sufficient to accommodate the head portion 88.

Figure 9:
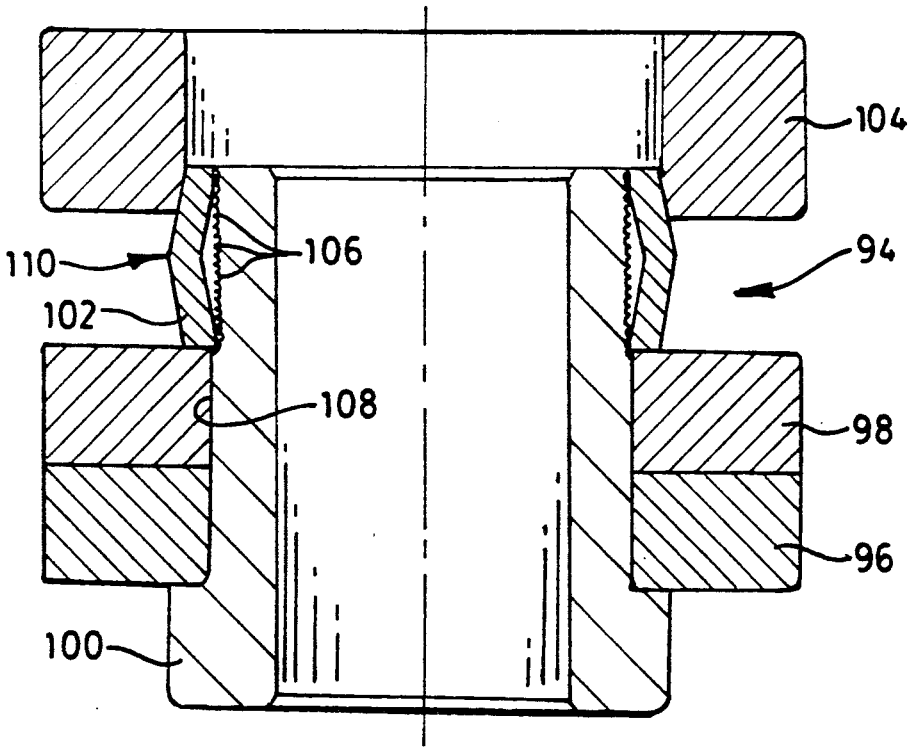
FIG. 9 is a diagrammatic sectional view of a mechanical joint between a plurality of elements and an alternate fastening apparatus used to join the elements together, the tool assembly of the present invention being adapted to install and remove the alternate fastening apparatus.

With particular reference to FIG. 9, an alternate fastening apparatus 94 is used to mechanically join a plurality of elements 96 and 98 together. The fastening apparatus 94 includes a fastening member 100, a deformable ring 102, and a sleeve 104. The fastening member 100 has a plurality of circumferential grooves 106 formed on the external circumferential surface 108 thereof, and the deformable ring 102 has an enlarged diameter middle portion 110. The subject tool assembly 10 operates in the manner previously described to press the fastening member 100 into the joint or juncture bore 112 between the elements 96 and 98. The tool assembly 10 is then used to press the sleeve 104 over the ring 110 and deform the ring 110 into the grooves 106. The subject tool assembly 10 also operates in the previously described manner to remove the fastening member from fastening engagement with the elements 96, 98 and the deformable ring 102.

Figure 10:
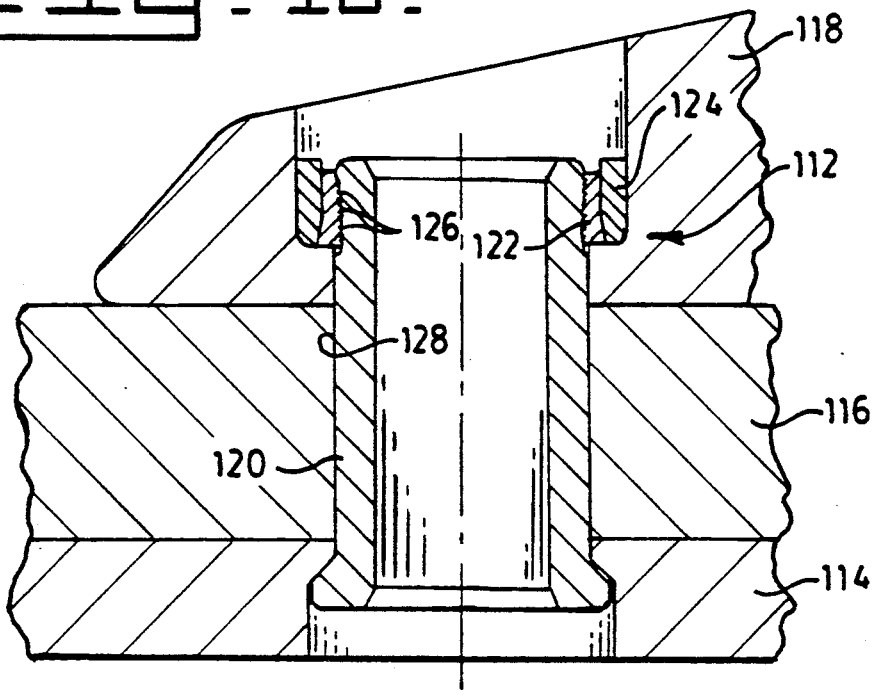
FIG. 10 is a diagrammatic sectional view of a mechanical joint between a plurality of elements and a second alternate fastening apparatus being used to join the elements together, the tool assembly of the present invention being adapted to install and remove this second alternate fastening apparatus.

With reference to FIG. 10, another alternate fastening apparatus 112 is useful with the subject tool assembly 10 to mechanically join a plurality of members 114, 116, and 118 together. The fastening apparatus 112 includes a fastening member 120, a deformable ring 122, and a backup sleeve 124. The fastening member 120 has a plurality of circumferential grooves 126 formed on the external circumferential surface 128 thereof. As the ring 122 is pressed into place, the ring is deformed into the grooves to lock the elements 114, 116, and 118 together. Removal of the fastening member 120 is accomplished, as previously described by shearing the ring 122 from the fastening member 120.

With particular reference to FIGS. 11 and 12, the bail 39 curves upwardly to a position approximately above the center of gravity of the fluid power source 56 and the tool assembly 10. A movable hook assembly 130 is positioned on the bail 39 and is movable along the bail 39. The hook assembly 130 includes a U-shaped hook 132 having first and second legs 134, 136, which are joined by a shaft 138. A roller 140 is positioned on the shaft 138 and engages the bail 39. The hook assembly 130 can move to any position along the bail 39, but is normally in the position shown in FIG. 11, or in a position approximately 90° to this position. The tool assembly 10 can therefore be supported by the hook assembly 130 in a horizontal position or a vertical position. A plate 142 is secured to the upper end of the bail 39 to prevent the hook assembly 130 from being removed from the bail 39.

INDUSTRIAL APPLICABILITY

With reference to the drawings, the subject tool assembly 10 is particularly suited for installing and removing a mechanical fastening apparatus 12 in a joint 14 between a plurality of elements 16 and 18. With the fluid power source 56 and the rod 20 suspended vertically above, or horizontally in line with the elements 16, 18 by the curved bail 39, the first tool 22 and the fastening member 28 is positioned on the rod 20. The rod 20 is then guided through the joint 14 until the fastening member 28 is adjacent the joint 14. The second tool 24 is then positioned on the rod 20 first surface 44 adjacent the element 18. The securing member 26 is now threaded onto the threaded end portion 34 of the rod 20 until it contacts the second surface 46 of the second tool 24 and the first surface 44 contacts the element 18. the securing member 26 can be manipulated by the first and second handles 66, 68.

At this time, the fluid power source 56 is activated and the rod 20 is moved from the first position 52 to the second position 54. By such movement, the fastening member 28 is moved from the position shown in FIG. 1 to the position shown in FIG. 2, and within the joint 14. The oil flow to the fluid power source is now reversed and the rod 20 moves to its first position 52. The securing member 26 and the second tool 24 are removed from the rod 20, the hardened bushing 33 and the deformable ring 32 are slipped over the end of the fastening member 28, the third tool 72 is positioned on the rod member 20, as shown in FIG. 3, and the securing member is rethreaded onto the rod 20. The fluid power source 56 is once again activated to move the rod 20 from the first position 52 to the second position 54, as shown in FIG. 3. By such movement, the deformable ring 32 is deformed into the grooved surface 30, which mechanically locks the elements 16 and 18 together. The fluid power 56 source is now deactivated and the tool assembly 10 is disassembled and removed from the joint 14. The elements 16, 18 remained joined together until the fastening member 28 is removed by the subject tool assembly 10.

When either of the elements 16, 18 need to be replaced, or serviced, the tool assembly 10 is again fastened to the elements 16, 18, as shown in FIG. 4. In this configuration, the second tool 24 is positioned on the rod 20 between the fluid power source 56 and the element 18, and the third tool 72 is positioned on the rod 20 between the securing member 26 and the element 18. The third tool 72 is so positioned that the second end portion 76 is adjacent the fastening member 28. The fluid power source 56 is now activated to move the rod 20 from the first position 52, as shown in FIG. 4, to the second position 54, as shown in FIG. 5. By such movement, the portion of the deformed ring 32 within the grooved surface 30 is sheared and the fastening member is moved out of the joint 14 and into the counterbore 45 of the second tool 24. The fluid power source 56 is now de-activated and the tool assembly is disassembled and removed from the joint 14. The elements 16 and 18 can now be disassembled and replaced or serviced.

Other aspects, objects, and advantages of this invention can be obtained from a study of the drawings, the disclosure, and the appended claims.

What is claimed is:

1. A tool assembly for installing a removable fastening apparatus in a joint between a plurality of elements, said fastening apparatus including a fastening member and a deformable ring, said fastening member having a grooved surface, said tool assembly comprising:

a movable rod having a first threaded end portion, said rod being adapted to penetrate said joint;

a first tool having a first surface and being positionable on said rod, said first surface being adapted to contact said fastening member;

a second tool having first and second surfaces and being positionable on said rod, said first surface being adapted to contact one of said elements;

a securing member having a first surface and being positionable on said first end portion of said rod with said first surface being in contact with said second surface of said second tool;

first means for moving said rod between a first position at which said fastening member is spaced from said joint, and a second position at which said fastening member is positioned within said joint and in contact with said elements; and second means for deforming said ring into said grooved surface of said fastening member.

2. A tool assembly, as set forth in claim 1, wherein said first means for moving said rod include a fluid power source, said rod being connected to and positioned between said fluid power source and said securing member.

3. A tool assembly, as set forth in claim 1, wherein said second means for deforming said ring includes a third tool having first and second end portions, said third tool being adapted to replace said second tool on said rod with said first end portion of said third tool being adapted to contact said deformable ring and said second end portion being adapted to contact said first surface of said securing member.

4. A tool assembly, as set forth in claim 1, wherein said securing member includes a nut having an internal threaded portion and an external surface, and first and second manipulating handles secured to and extending outwardly of said surface.

5. A tool assembly, as set forth in claim 1, wherein said second tool member includes a bore and a counterbore, said bore being of a size sufficient to accommodate a portion of said rod.

6. A tool assembly for removing a fastening apparatus from fastening engagement with a plurality of elements, said fastening apparatus including a fastening member having an enlarged diameter head portion, and a mechanically deformed ring, said tool assembly comprising:

a movable rod having a first end portion, said rod being adapted to penetrate said elements and said fastening apparatus;

a cup-shaped tool having a first surface and being positionable on said rod, said first surface being adapted to contact one of said elements, said cup-shaped tool further having a bore and a counterbore, said bore being of a size sufficient to accommodate a portion of said rod, and said counterbore being of a size sufficient to accommodate said fastening member head portion;

an elongated tool having first and second end portions, said first end portion having an enlarged base and said second end portion being adapted to contact said fastening member;

a securing member having a first surface and being engageable with said first end portion of said rod, said first surface being adapted to contact said first end portion of said elongated tool; and means for moving said rod between a first position at which said fastening member is positioned within said joint and a second position at which said fastening member is spaced from said joint.

7. A tool assembly, as set forth in claim 6, wherein said means for moving said rod include a fluid operated cylinder and piston.

8. A tool assembly, as set forth in claim 6, wherein said rod is adapted to penetrate said elongated tool.

9. A tool assembly, as set forth in claim 6, wherein said securing member is threaded and includes a nut having an internal threaded portion and an external surface, and a manipulating lever secured to and extending outwardly of said external surface.

10. A tool assembly for installing a connecting apparatus in a juncture bore between a plurality to elements and for removing said connecting apparatus from said juncture bore, said connecting apparatus including a fastening member and a deformable ring, said fastening member having a grooved surface, said tool assembly comprising:

an elongated shaft having a first threaded end portion and a second end portion having an enlarged head;

a first tool having a first surface and being positionable on said shaft, said first surface being adapted to contact said fastening member;

a second tool having first and second surfaces and being positionable on said shaft, said first surface being adapted to contact one of said elements;

a securing member having an internal threaded portion and a surface portion, said internal threaded portion being threadably engageable with said threaded end portion of said shaft;

first means for moving said shaft between a first position at which said fastening member is spaced from and adjacent said juncture bore and a second position at which said fastening member is positioned within said juncture bore; and second means for moving said shaft between a first position at which said deformable ring is spaced from and adjacent said grooved surface of said fastening member and a second position at which said deformable ring is deformed and engaged with said grooved surface.

11. A tool assembly, as set forth in claim 10, wherein said second means includes a third tool having a first end portion adapted to contact said deformable ring.

12. A tool assembly, as set forth in claim 10, wherein said first means for moving said shaft include a fluid operated cylinder and piston.

13. A tool assembly, as set forth in claim 10, including means for removing said deformed ring from engagement with said grooved surface of said fastening member.

14. A tool assembly, as set forth in claim 13, wherein said means for removing said deformed ring includes a third tool having first and second end portions, said first end portion being adapted to contact said surface portion of said securing member, and said second end portion being adapted to contact said fastening member.

15. A tool assembly, as set forth in claim 14, wherein said means for removing said deformed ring includes moving said shaft between a first position at which said fastening member is positioned within said juncture bore and a second position at which said fastening member is removed from said juncture bore and said deformed ring is removed from engagement with said fastening member.

* * * * *